United States Patent [19]

Bindra et al.

[11] Patent Number: 4,540,473

[45] Date of Patent: Sep. 10, 1985

[54] COPPER PLATING BATH HAVING INCREASED PLATING RATE, AND METHOD

[75] Inventors: Perminder S. Bindra, Ossining; Allan P. David; Raymond T. Galasco, both of Binghamton; Charles E. Gasdik, Endicott; David N. Light, Briarcliff Manor; Paul B. Pickar, Vestal, all of N.Y.

[73] Assignee: International Business Machines Corporation, Armonk, N.Y.

[21] Appl. No.: 554,484

[22] Filed: Nov. 22, 1983

[51] Int. Cl.[3] ..... C25D 3/38

[52] U.S. Cl. ..... 204/52 R; 204/44

[58] Field of Search ..... 204/52 R, 44, 106, DIG. 13, 204/DIG. 2

[56] References Cited

U.S. PATENT DOCUMENTS

| | | | |
|---|---|---|---|
| 2,391,289 | 12/1945 | Beaver, Jr. | 204/52 |
| 2,762,762 | 9/1956 | Donahue | 204/11 |
| 3,328,273 | 6/1967 | Creutz et al. | 204/52 R |
| 3,617,451 | 11/1971 | Slominski et al. | 204/34 |
| 3,767,539 | 10/1973 | Clauss et al. | 204/52 |
| 3,838,025 | 9/1974 | Toledo et al. | 204/52 |

FOREIGN PATENT DOCUMENTS

| | | | |
|---|---|---|---|
| 49603 | 12/1934 | Denmark | 204/52 R |
| 1521021 | 8/1969 | Fed. Rep. of Germany | 204/DIG. 2 |
| 40-3404 | 2/1965 | Japan . | |
| 3611 | 1/1974 | Japan | 204/52 R |
| 38053 | 11/1979 | Japan | 204/52 R |
| 7114979 | 5/1972 | Netherlands . | |
| 91289 | 1/1938 | Sweden | 204/52 R |
| 322371 | 12/1929 | United Kingdom . | |
| 139449 | 12/1960 | U.S.S.R. | 204/52 R |
| 183002 | 11/1964 | U.S.S.R. . | |
| 234089 | 8/1969 | U.S.S.R. . | |

OTHER PUBLICATIONS

IBM Technical Disclosure Bulletin, "Electrodeposited Copper Films", H. Koretzky and P. T. Woodberry, vol. 9, No. 7, 12/66, p. 750.

Metal Finishing, "The Deposition of Copper from Phosphoric Acid Solutions", C. B. F. Young and F. Nobel, 11/49, pp. 56–59.

*Primary Examiner*—G. L. Kaplan

*Attorney, Agent, or Firm*—Pollock, Vande Sande & Priddy

[57] ABSTRACT

A copper plating bath containing a sulfur-containing anion other than sulfate anion and/or a selenium-containing anion other than a selenate anion and/or a tellurium-containing anion other than a tellurate anion in an amount sufficient to increase the plating rate, and method for electroplating copper onto a substrate with the plating bath.

16 Claims, 3 Drawing Figures

COPPER PLATING BATH HAVING INCREASED PLATING RATE, AND METHOD

DESCRIPTION

1. Technical Field

The present invention is concerned with an electrolytic copper plating bath having an increased rate of plating to thereby provide increased throughput. In addition, the present invention is concerned with a method for electroplating copper onto a substrate employing a copper plating bath of increased plating rate. The present invention is concerned with providing increased plating rate for copper without a concomitant loss in the electrical properties of the plated copper.

2. Background Art

One technique used extensively for plating copper onto a substrate is by electrolytic process using, for example, an acidic copper plating bath. The rate at which the copper can be electroplated depends upon the current density employed. However, the current density can not be increased indefinitely since under most conditions, the deposition potential is then driven cathodically with certain adverse results occurring. For instance, the higher the current density, the greater the likelihood that the quality of the deposited film will be decreased. For instance, at relatively high current densities rough, powdery, or loosely adhering electrodeposits are likely to occur. In addition, at high current density, hydrogen evolution or other side reactions occur simultaneously with the metal deposition reaction, thus complicating the ability to evaluate the electrodeposition process and its rate as a function of various variables of the process. Furthermore, the current efficiency decreases as the current density is increased above the diffusion limiting current value, referred to as $i_D$.

Accordingly, it has been found that copper deposits of good quality are assured by maintaining the applied steady state electroplating rate at about $i_D/4$.

One suggestion for increasing the rate of deposition has been to incorporate finely distributed gases into the plating bath while, at the same time, increasing the current density as exemplified by British Patent No. 322371. However, such process does not result in the type of high quality copper desired for electronic circuitry.

SUMMARY OF INVENTION

In accordance with the present invention, the plating rate can be increased to a value corresponding to the diffusion limiting current $i_D$ without having an adverse effect upon the properties of the electrodeposited film. In accordance with the present invention, the plating rate is increased without a concomitant decrease in the properties of the film by introducing into the plating bath at least one member from the group of sulfur-containing anion other than a sulfate ($SO_4$) ion, selenium-containing anion other than a selenate anion, tellurium-containing anion other than a tellurate, or mixtures in an amount sufficient to increase the plating rate. Said anions act like catalysts for the electroplating process.

In particular, the present invention is concerned with an acidic-electrolytic copper plating bath which comprises a cupric ion source, an acid, and at least one member from the group of selenium-containing anion other than a selenate anion; tellurium-containing anion other than a tellurate anion, sulfur-containing anions other than sulfate ions, or mixtures thereof in an amount sufficient to increase the plating rate.

Moreover, the present invention is concerned with a method for electroplating copper onto a substrate. The process comprises providing a substrate and an electrode in contact with an acidic-electrolytic copper plating bath of the type described hereinabove and passing an electric current through the plating bath in a direction to make the substrate a cathode.

BEST AND VARIOUS MODES FOR CARRYING OUT INVENTION

Figure 1:
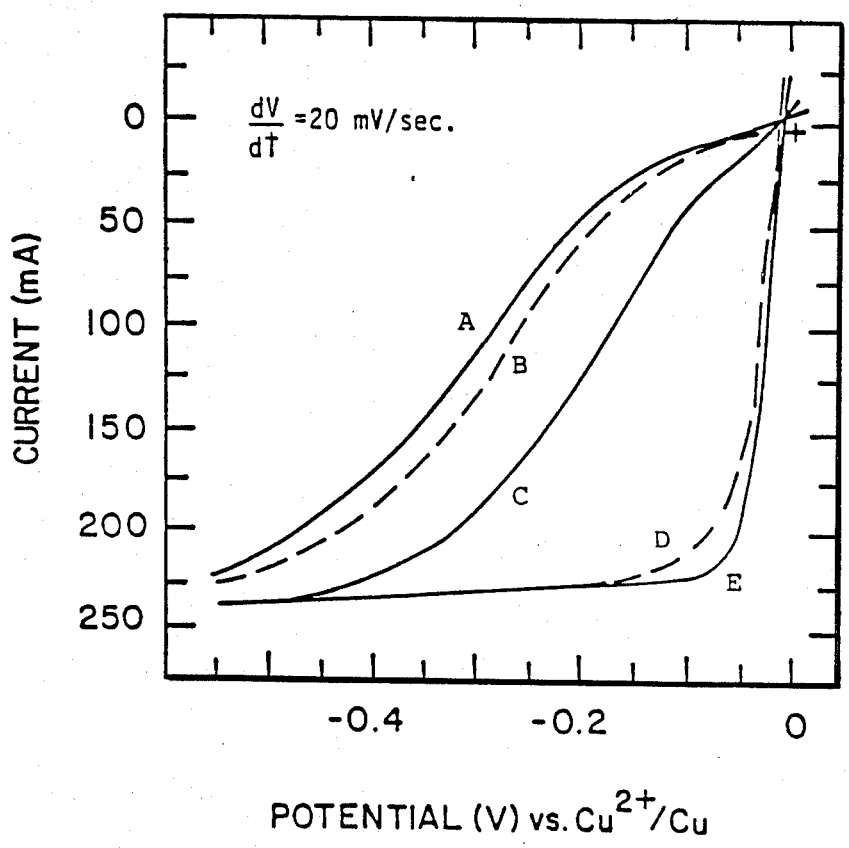
FIGS. 1 and 2 are polarization curves illustrating the effectiveness of the present invention.

The present invention is concerned with increasing the plating rate of an acidic-electrolytic copper plating bath. Moreover, the present invention is especially concerned with increasing the plating rate without adversely affecting to an undesirable extent the quality of the plated film. In accordance with the present invention, a selenium-containing anion other than a selenate anion, or a tellurium-containing anion other than a tellurate, or preferably a sulfur-containing anion other than a sulfate anion is incorporated into an acidic copper electrolytic plating bath. Mixtures of such anions can be employed if desired. Examples of some suitable sulfur-containing anions include sulfite ($SO_3^{2-}$), sulfide ($S^{2-}$), thiosulfate ($S_2O_3^{2-}$), $HSO_3^-$, and $S_4O_6^{2-}$. Sulfate anions which are present in conventional copper electroplating baths do not increase the plating rate to the extent achieved by the present invention. This is evidenced by the fact that the addition of relatively minor amount of the above-defined sulfur-containing anions significantly increase the plating rate of copper baths which contain relatively large amounts of sulfate anions (e.g.—at least 1 molar).

Examples of selenium-containing anions include selenite ($SeO_3^{2-}$) and selenide ($Se^{2-}$). Examples of tellurium anions include tellurite ($TeO_3^{2-}$) and telluride ($Te^{2-}$).

It is believed, in accordance with the present invention, that the above defined anions catalyze the metal ion discharge step at the solution-metal interphase during the copper plating. Along these lines, in the absence of applied current, the electrode potential is $E_0$, which depends upon the bath composition. The cathode must be polarized during electroplating to a more negative value, for example, $E_1$ and the difference, $E_1-E_0$, is the overpotential $\eta$. The polarization of the cathode is necessary to overcome the overpotentials associated with the various stages of the copper deposition reaction. The total overpotential, $n_t$, can be expressed in terms of the components for the various stages of the electrodeposition process by the following expression:

$$\eta_t=\eta_A+\eta_D+\eta_C$$

wherein $\eta_A$, $\eta_D$, and $\eta_C$ are the charge transfer, diffusion, and crystallization overpotentials respectively.

At the normal plating current density, the deposition of copper is controlled by the discharge step and occurs via the following step-wise mechanism:

$$Cu^{2+}+e^-\rightarrow Cu^+$$

$$Cu^{+} + e^{-} \rightarrow Cu^{\cdot}$$

wherein the first electron transfer represents the rate determining step. The size of the initial nuclei at the normal plating current density $i_D/4$ is obtained from the Gibb's-Kelvin Equation, as follows:

$$r^* = \frac{2M}{\rho Z F \eta_t} \Sigma\sigma_i$$

$r^*$ = radius of the critical nucleus $\Sigma\sigma_i$ = average interfacial energy of the various facets of the nucleus M = molecular wt. of copper $\rho$ = density of copper z = no. of electrons involved in converting $Cu^{2+}$ to $Cu^0$ F = Faraday The grain size and the ductility of the copper deposit are determined by $r^*$ and consequently by $\eta_t$. The rate for the copper plating process is the current density.

In accordance with the present invention, the presence of the above-defined anions such as the sulfur-containing anions other than the sulfate ions increases the current density in the potential region where charge transfer is the rate determining step. Accordingly, the copper deposition occurs at a much faster rate without adversely effecting the grain size or the ductility of the copper deposit to an undesirable extent.

Although various organic sulfur-containing compounds have been suggested as additives to copper plating baths, such do not provide the anions as required by the present invention, nor have such been added for the purposes of increasing the plating rate. For instance, U.S. Pat. No. 2,391,289 to Beaver suggests a bath of copper sulfate, sulphuric acid, and thiourea, $[CS(NH_2)_2]$, used as a brightener. High current densities are suggested by the addition to the bath of materials such as dextrin, sugar, or sulfonated creosote. Moreover, suggested as a wetting agent is isopropyl naphthalene sulfate.

Dutch Patent No. 31451T-EN suggests a bath for providing a bright copper deposit by incorporation of a complex of sulfur, selenium, and a hydrocarbon chain.

Russian Patent No. 234089 suggests adding sodium selenite to an alkaline copper electrolytic plating bath.

U.S. Pat. No. 2,762,762 to Donahue suggests the addition of chlorine to copper plating baths.

U.S. Pat. No. 3,767,539 to Clauss, et al. suggests the addition of materials containing sulfonic acid in conjunction with a selenium compound in copper plating baths in order to obtain bright copper deposits.

Young, "The Deposition of Copper From Phosphoric Acid Solutions", *Metal Finishing*, Dec. 1949, pp. 56–59, suggests the use of copper salts of alkanesulfonic acids in copper plating baths.

The source for the sulfur-containing anion or selenium-containing anion or the tellurium-containing anion can be any inorganic material which is soluble in the plating bath and includes the acid form of the sulfur-containing anion, or selenium-containing anion, or the tellurium-containing anion, as well as metal salts thereof such as the alkali metal salts including sodium, potassium, and lithium; and the ammonium salts of the corresponding sulfur-containing anions, or selenium-containing anions, or tellurium-containing anions. In addition, the desired anion can be added in gaseous form such as by bubbling a gas into the bath such as $H_2S$ or $SO_2$.

The amount of sulfur-containing anion other than sulfate anion and/or selenium-containing anion other than selenate anion and/or tellurium-containing anion other than tellurate anion present in the bath is generally from about $10^{-6}$ to about $10^{-3}$M (molar) and preferably about $10^{-4}$ to about $10^{-5}$M.

It is important not to include quantities of said sulfur-containing anions and/or selenium-containing anions and/or tellurium-containing anions in great excess of the amounts suggested herein since such anions in greater amounts tend to deposit along with the copper in the film and if present in excessive quantities, could adversely affect the properties of the film to an undesired extent.

By employing the above-defined anions and especially the said sulfur-containing anions in accordance with the present invention, the plating rate can be increased by a factor of at least about 4 without any adverse or deleterious effect upon the quality of the plated copper.

In addition, the plating bath includes a source of cupric ions and an inorganic mineral acid such as sulphuric acid. The preferred source of the cupric ions is $CuSO_4.5H_2O$. Preferred copper plating baths contain the source of cupric ion in an amount of about $10^{-2}$ to about 0.5 molar and preferably in an amount of about 0.1 to about 0.3 molar. The inorganic acid is added to the plating bath in an amount such that the ionic strength of the bath is from about 5 molar to about 9 molar. Preferably, the inorganic acid is added in amounts of about 1.5 to about 2.5 molar.

In addition, the bath can contain other additives such as brighteners including chloride ions such as in amounts of about 30 to about 70 ppm and organic brightener additives such as polyalkylene glycols. The organic brighteners are usually added in amounts of about 0.5 to about 1.25% by weight of the plating bath. The preferred polyalkylene glycols include polyethylene glycol and polypropylene glycol. The preferred polyethylene glycols and polypropylene glycols usually have molecular weights of about 400 to about 1000 and preferably about 600 to about 700. Moreover, multicomponent organic additives can be employed such as those containing a polyalkylene glycol along with an organic sulfur-containing compound such as benzene sulfonic acid, safranine-type dyes, and sulfoorganic aliphatic compounds including disulfides, and/or nitrogen-containing compounds such as amides. Examples of amides include acrylamide and propylamide.

In the plating process, a suitable substrate to be plated is contacted with the plating bath. Suitable substrates include copper, gold, and carbon. In addition, an anode is also placed in contact with the plating bath and includes such materials as copper, noble metals such as gold, or carbon. The anode surface area is generally usually at least about 5 times the surface area of the cathode.

A voltage source is provided to provide an electric current through the plating bath in a direction so as to make the desired substrate to be coated a cathode. The potential is preferably that which would provide a $i_D/4$ in the absence of the added anion of the type defined hereinabove and about −0.05 to about −0.3 volts and more preferably about −0.5 to about −0.2 volts, as measured against a $Cu^{+2}/Cu$ reference electrode at about 24° C.

The plating is usually carried out at about normal room temperature (e.g.—about 24° C.).

Figure 3:
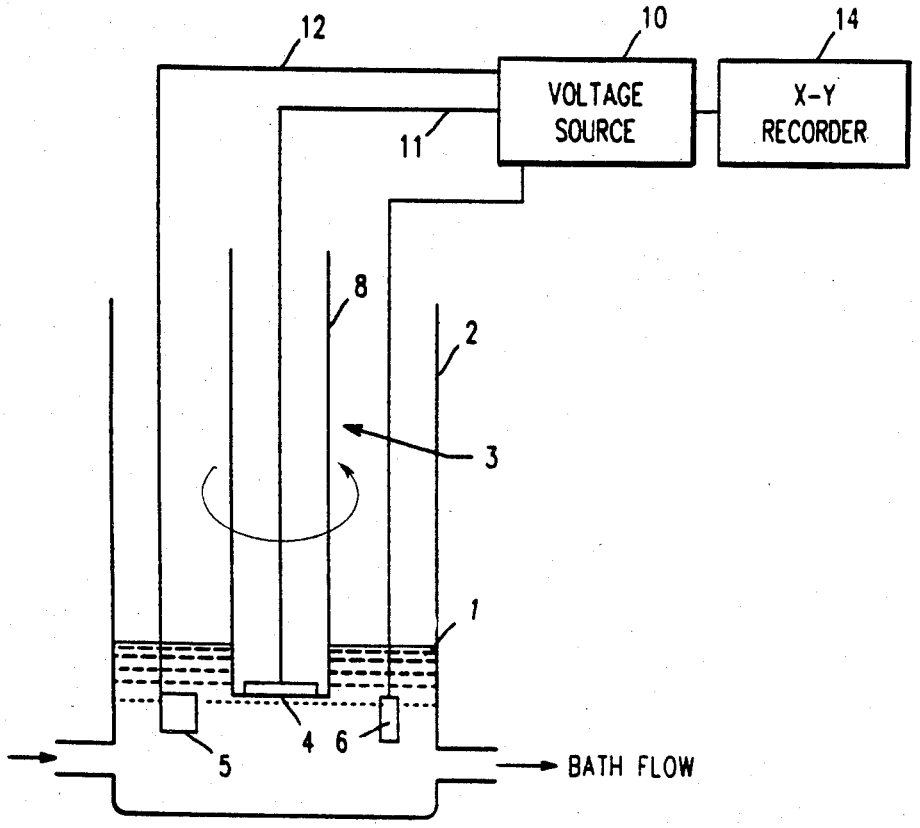
FIG. 3 is a schematic diagram of apparatus suitable for carrying out the present invention.

Reference to FIG. 3 illustrates suitable apparatus for carrying out the process of the present invention. Numeral 1 refers to the depth of the plating bath in the plating tank 2. Numeral 3 refers to a rotating disc electrode having a gold disc 4 where the plating occurs and Teflon ® jacket 8. The gold disc is connected to the constant voltage supply source 10 by wire 11. The anode is electrically connected to the voltage supply source 10 via wire 12. The reference electrode 6 is connected to a voltage source 10 by wire 13. The current at different potentials is measured by and recorded on an X-Y recorder 14. The following non-limiting examples are provided to further illustrate the present invention.

EXAMPLE 1

A gold rotating disc cathode having a surface area of about 0.458 $cm^2$ is introduced into a copper electrolytic plating bath containing about 0.2 M $CuSO_4$ and about 1.0 M $H_2SO_4$ with varying amounts of sodium sulfite as shown in FIG. 1. The rate of rotation of the rotating disc gold cathode is about 400 rpm. In addition, a gold anode having a surface area about 5 times that of the cathode and a $Cu^{+2}/Cu$ reference electrode are placed in the plating bath. The electrode potential is controlled with a potentiostat in conjunction with a wave form generator to provide the desired wave potential form for the measurements. The scanning rate (dV/dt) employed is 20 mv/seconds. The electrolyte is made oxygen-free by bubbling pure nitrogen through the electrolyte prior to and during the measurements. The temperature of the plating bath is about 24° C. The voltage of the plating substrate is scanned from 0.4 volts to −0.5 volts versus a $Cu^{2+}/Cu$ reference electrode. The polarization curves obtained are recorded on an IBM instrument X-Y recorder.

However, in the actual use, as contrasted to evaluating the baths to illustrate the effectiveness of the present invention, either the current and/or potential used will preferably remain substantially constant.

Reference to FIG. 1 shows polarization curves for copper deposition in the absence of sulfite ions and in the presence of varying amounts of sulfite ions.

The curve in FIG. 1 labeled "A" refers to a bath free from the anions required by the present invention. The curve in FIG. 1 labeled "B" is from a bath which contains $5\times10^{-6}$ M sulfate. The curve in FIG. 1 labeled "C" is from a bath which contains $5\times10^{-6}$ M sulfite. The curve in FIG. 1 labeled "D" is from a bath which contains $1.5\times10^{-5}$ M sulfite. The curve in FIG. 1 labeled "E" is from a bath which contains $5\times10^{-5}$ sulfite. The polarization curves in FIG. 1 clearly demonstrate that the plating rate increases substantially in the kinetic region in the presence of the sulfite ion thereby demonstrating the catalytic-like effect provided by the sulfite ion. The maximum effect, as shown in the curves, occurs at sulfite concentration of about $5\times10^{-5}$ M.

The following Table 1 demonstrates the effect of the sulfite concentration on the kinetic current for the copper deposition from the measurements obtained. The Table and results achieved clearly show that the maximum increase occurs in the potential region of −0.5 v to −0.2 v which coincides with the potential at which acid copper plating is normally carried out with the plating baths in accordance with the present invention. The kinetic current for copper deposition $i_k$, which corresponds to the plating rate in the absence of diffusion effects, is calculated from the expression:

$$i_k = i \cdot i_D / i_D - i$$

wherein i is the current at a fixed potential and $i_D$ is the experimental difusion limiting current at 400 rpm.

TABLE 1

Effect of Sulfite Concentration on Kinetic Current for Copper Deposition

| Potential (V) vs. $Cu^{2+}/Cu$ | KINETIC CURRENT (mA) AT 400 rpm No Sulfite | $10^{-6}$M Sulfite | $5\times10^{-6}$M Sulfite |
|---|---|---|---|
| −0.05 | 0.0486 mA | 0.0568 | 0.1674 |
| −0.10 | 0.1316 | 0.1509 | 0.4530 |
| −0.15 | 0.2957 | 0.3414 | 1.104 |
| −0.20 | 0.6463 | 0.7466 | 2.380 |

EXAMPLE 2

A highly polished single crystal copper substrate of about 1 inch diameter is contacted at a constant potential of −0.110 volt versus $Cu^{+2}/Cu$ reference electrode in a plating bath containing about 0.236 M copper sulfate and 1.67 M sulphuric acid. The total plating time is about 2.87 hours and the bath is agitated using a magnetic stirrer.

A second sample is processed in the same bath under the same conditions, except that 0.0018 M sodium sulfate is added to the bath.

X-ray diffraction studies are performed on the copper plated on the single crystal substrates. The results indicate that the copper crystal structure is relatively unaffected by the presence of the sodium sulfite in the plating bath. Both the crystal growth mechanism and the average grain size are essentially constant. The consistent spacing of the diffraction lines predict the same internal stress in both plated copper samples. Accordingly, it can be concluded that the present invention provides for increasing the plating rate without adversely effecting the plated copper metallurgy.

EXAMPLE 3

Figure 2:
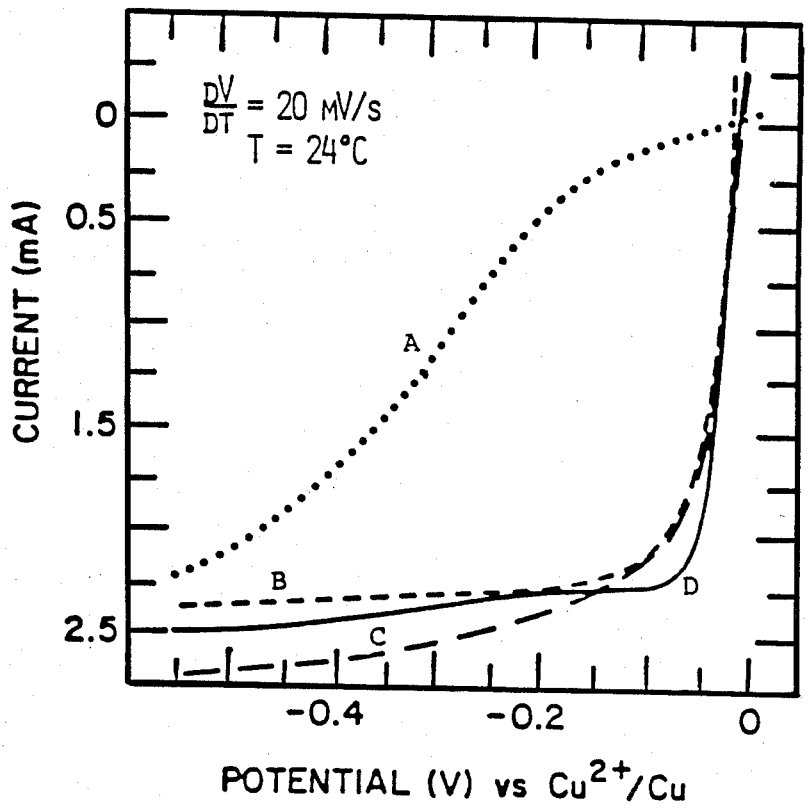

The general procedure of Example 1 is repeated, exoept that the baths used contain amounts of sodium sulfite, sodium sulfide, or sodium thiosulfate, as indicated in FIG. 2. The polarization curves shown in FIG. 2 are obtained. These curves demonstrate the effect of various sulfur-containing anions to increase the plating rate. It is noted that since the copper bath already contains relatively large amounts of sulfate ions, the sulfate ions do not provide the significant increase in the plating rate as achieved by the present invention.

What is claimed is:

1. An acidic-electrolytic copper plating bath comprising a cupric ion source, an acid, and sulfur-containing anions other than sulfate ions and wherein said sulfur-containing anions are from an inorganic material in an amount sufficient to increase the plating rate and being present in an amount of about $10^{-6}$ to about $10^{-3}$ M, and wherein the acid is added in an amount sufficient that the ion strength of the bath is about 5 to about 9 M.

2. The copper plating bath of claim 1 wherein said sulfur-containing anions are present in an amount of about $10^{-4}$ to about $10^{-6}$ M.

3. The copper plating bath of claim 1 wherein said sulfur-containing anions are present in an amount of about $10^{-4}$ to about $10^{-5}$ M.

4. The copper plating bath of claim 1 wherein said sulfur-containing anions are selected from the group of sulfite anions, sulfide anions, thiosulfate anions, $HSO_3$, and $S_4O_6$.

5. The copper plating bath of claim 1 wherein the source of said cupric ion is present in an amount of about $10^{-2}$ to about 0.5 M.

6. The copper plating bath of claim 1 wherein the source of said cupric ion is present in an amount of about 0.1 to about 0.3 M.

7. The copper plating bath of claim 1 wherein the acid is added in an amount of about 1.5 to about 2.5 M.

8. The plating bath of claim 1 wherein said source of cupric ion is $CuSO_4.5H_2O$ and said source of acid is $H_2SO_4$.

9. A method for electroplating copper onto a substrate which comprises providing said substrate and an electrode in contact with an acidic-electrolytic copper plating bath comprising a cupric ion source, an acid in an amount sufficient that the ion strength of the bath is about 5 to about 9 M, and sulfur-containing anions other than sulfate ions, wherein said sulfur-containing ions are from an inorganic material in an amount sufficient to increase the plating rate and being present in an amount of about $10^{-6}$ to about $10^{-3}$ M; and passing an electric current through said plating bath in a direction to make said substrate a cathode.

10. The process of claim 9 wherein the potential is about −0.05 to about −0.3 volts as measured against a $Cu^{+2}/Cu$ reference electrode at about 24° C.

11. The process of claim 10 wherein said potential is about −0.05 to about −0.2 volts.

12. The process of claim 9 wherein said sulfur-containing anions are selected from the group of sulfite anions, sulfide anions, thiosulfate anions, $HSO_3$, and $S_4O_6$.

13. The process of claim 9 wherein said sulfur-containing anions are present in an amount of about $10^{-4}$ to about $10^{-5}$ M.

14. The process of claim 9 wherein said sulfur-containing anions are present in an amount of about $10^{-4}$ to about $10^{-6}$ M.

15. The process of claim 9 wherein said source of cupric ion is $CuSO_4.5H_2O$ and said source of acid is $H_2SO_4$.

16. The process of claim 9 wherein the source of said cupric ion is present in an amount of about 0.1 to about 0.3 M and wherein the acid is added in an amount of about 1.5 to about 2.5 M.

* * * * *